United States Patent [19]

Tanaka et al.

[11] 4,065,301

[45] Dec. 27, 1977

[54] METHOD FOR PRODUCING TITANIUM NITRIDE-BASE SINTERED ALLOYS

[75] Inventors: Hiroshi Tanaka, Aichi; Yoshihiro Yamamoto, Komaki, both of Japan

[73] Assignee: NGK Spark Plug Co., Ltd., Nagoya, Japan

[21] Appl. No.: 635,155

[22] Filed: Nov. 24, 1975

[30] Foreign Application Priority Data

Dec. 19, 1974 Japan ..... 49-146102

[51] Int. Cl.[2] ..... B22F 3/16; C22C 1/05

[52] U.S. Cl. ..... 75/203; 75/204; 75/205; 75/211; 75/238

[58] Field of Search ..... 75/201, 203, 204, 205, 75/211, 238; 29/182.7, 182.8, 182.5

[56] References Cited

U.S. PATENT DOCUMENTS

| | | | |
|---|---|---|---|
| Re. 25,815 | 7/1965 | Humenik et al. | 29/182.7 |
| 3,409,419 | 11/1968 | Yates | 29/182.7 X |
| 3,741,733 | 6/1973 | Kieffer | 29/182.7 X |
| 3,752,655 | 8/1973 | Ramquist | 75/205 X |

*Primary Examiner*—Richard E. Schafer

*Attorney, Agent, or Firm*—Stevens, Davis, Miller & Mosher

[57] ABSTRACT

Titanium nitride-base sintered alloys having high thermal shock resistance and high durability against high speed continuous cutting can be obtained by mixing a specifically limited amount of carbon with a basic powdery raw material mixture composed of TiN, Mo and/or $Mo_2C$ and an iron family metal, molding the resulting mixture and sintering the molded article. When not more than 50% by weight of the amount of TiN contained in the raw material mixture is replaced by at least one of TiC, WC and TaC, the sintering temperature can be lowered.

8 Claims, No Drawings

METHOD FOR PRODUCING TITANIUM NITRIDE-BASE SINTERED ALLOYS

The present invention relates to a method for producing titanium nitride-base sintered alloys suitable for high speed continuous cutting.

Titanium nitride attracts attention as a suitable material for cutting tools due to its excellent thermal conductivity and high thermal shock resistance. However, titanium nitride is very poor in the wettability with iron family metals used as a binder metal, and therefore titanium nitride is compounded merely to TiC-base or WC-base alloys at present in an amount of about 10–20% by weight, and when the compounding amount exceeds 30% by weight, blowholes are formed in the resulting sintered alloy, and the strength thereof is decreased.

TiC is very excellent in the wettability with iron family metals used as a binder metal when the iron family metals coexist with WC or $Mo_2C$, and can be formed into a dense sintered alloy. Therefore, it seems to be effective that a thin TiC layer is formed on the surface of TiN particles. However, the size of the TiN particles is very small, of micron order, and therefore it is technically difficult to adhere a uniform TiC layer to the surface of the TiN particles by any of the visual coating methods, such as the vapor phase deposition method, electrophoresis method, co-precipitation method and the like, and satisfactory results have not yet been obtained.

The inventors have found that, when a molded article obtained by molding a mixture composed of powdery TiN, powdery binder metal and a small amount of powdery carbon is heated, the binder metal begins to melt at about 1,280° C, and when the temperature is further raised, fine particles of powdery TiN and fine particles of powdery carbon are dissolved into the melted binder metal while nitrogen in said dissolved TiN is vapored out, and then the dissolved carbon and titanium react with each other and precipitate on the surface of large TiN particles in the form of TiC, thereby accomplishing the present invention by utilizing this precipitation phenomenon.

That is, the present invention has developed a method for producing novel titanium nitride-base sinteredalloys suitable for high speed continuous cutting, which comprises mixing carbon with a basic powdery raw material mixture composed of 65–95% by weight of TiN, not more than 50% by weight (not more than one-half) of the amount of the TiN being capable of being replaced by at least one of TiC, WC and TaC, 2–20% by weight of Mo and/or $Mo_2C$ and 3–15% by weight of at least one iron family metal, the mixing amount of said carbon being 0.2–6.8 by weight based on 100 parts by weight of TiN contained in said basic raw material mixture, molding the resulting mixture and sintering the molded article.

The following examples are given for the purpose of illustration of this invention and are not intended as limitations thereof.

EXAMPLE 1

TiN, $Mo_2C$, Ni, Co and Mo, each of which had an average particle size of about 1.2 $\mu$ and was commercially available as a raw material for sintered alloy used in cutting tools, and acetylene black of 98% purity were mixed in the mixing ratio shown in the following Table 1. In this mixing, the amount of acetylene black was set to 3 parts by weight based on 100 parts by weight of TiN. The resulting mixture was mixed and pulverized in a wet process for about 40 hours in a conventional manner by means of a stainless steel ball mill provided with cemented carbide balls. The mixture after pulverized had an average particle size of 0.6–0.8 $\mu$. The mixture was press-molded, and the molded article was sintered at 1,550°–1,730° C for 30 minutes under vacuum to obtain a sintered alloy tip for cutting tool. The transverse rupture strength and hardness of the tip were measured. Further, another sintered alloy tip for cutting tools was prepared under the same conditions as described above, and the tip was polished into dimensions of a length of 12.7 mm, a width of 12.7 mm and a thickness of 4.8 mm (R=0.8 mm), and the following machinability test by the tip was effected. The obtained results are shown in Table 1.

| Machinability test | |
|---|---|
| Rod of cast iron FC-20 | Continuous cutting |
| Cutting velocity | 180 m/min. |
| Depth of cut | 1.0 mm |
| Feed | 0.31 mm/rev. |
| Cutting time | 60 minutes |

Table I

| Sample No. | Composition (parts by weight) TiN | Mo | $Mo_2C$ | Binder metal | Acetylene black | Sintering temperature (° C) | Properties of sintered alloy tip: Transverse rupture strength (Kg/mm²) | Hardness (HRA) | Flank abrasion (mm) | Remarks |
|---|---|---|---|---|---|---|---|---|---|---|
| 1 | 95 | 2 | | Ni 3 | 2.85 | 1,730 | 97 | 92.6 | 0.91 | |
| 2 | 90 | 5 | | Ni 5 | 2.70 | 1,700 | 99 | 92.5 | 0.21 | |
| 3 | 85 | 10 | | Ni 5 | 2.55 | 1,650 | 98 | 92.5 | 0.21 | |
| 4 | 85 | 5 | | Ni 10 | 2.55 | 1,650 | 109 | 92.2 | 0.22 | |
| 4a | 85 | 5 | | Co 10 | 2.55 | 1,650 | 109 | 92.0 | 0.22 | |
| 4b | 85 | 5 | | Ni 5, Co 5 | 2.55 | 1,650 | 108 | 92.2 | 0.21 | |
| 4c | 85 | | 5 | Ni 10 | 2.55 | 1,650 | 108 | 92.2 | 0.21 | |
| 4d | 85 | 3 | 2 | Ni 10 | 2.55 | 1,650 | 108 | 92.2 | 0.21 | |
| 5 | 80 | 15 | | Ni 5 | 2.40 | 1,600 | 102 | 92.4 | 0.22 | |
| 6 | 80 | 10 | | Ni 10 | 2.40 | 1,600 | 110 | 92.1 | 0.21 | |
| 7 | 77 | 20 | | Ni 3 | 2.31 | 1,600 | 98 | 92.7 | 0.19 | |
| 8 | 75 | 15 | | Ni 10 | 2.25 | 1,580 | 105 | 92.1 | 0.20 | |
| 9 | 75 | 10 | | Ni 15 | 2.25 | 1,580 | 117 | 91.9 | 0.25 | |
| 10 | 70 | 20 | | Co 10 | 2.10 | 1,570 | 109 | 92.2 | 0.21 | |
| 10a | 70 | 20 | | Ni 10 | 2.10 | 1,570 | 105 | 92.1 | 0.22 | |
| 10b | 70 | 15 | 5 | Ni 10 | 2.10 | 1,570 | 106 | 92.2 | 0.21 | |
| 10c | 70 | 5 | 15 | Co 10 | 2.10 | 1,570 | 106 | 92.2 | 0.20 | |
| 11 | 65 | 20 | | Ni 15 | 1.95 | 1,570 | 116 | 92.1 | 0.24 | Outside |

Table I-continued

| Sample No. | Composition (parts by weight) TiN | Mo | $Mo_2C$ | Binder metal | Acetylene black | Sintering temperature (° C) | Properties of sintered alloy tip: Transverse rupture strength (Kg/mm²) | Hardness (HRA) | Flank abrasion (mm) | Remarks |
|---|---|---|---|---|---|---|---|---|---|---|
| 12 | 77 | 12 | | Ni 1 | 2.31 | 1,600 | 58 | 90.1 | Chipped after 5 minutes | the present invention (Ni) |
| 13 | 75 | 22 | | Ni 3 | 2.25 | 1,580 | 78 | 91.1 | Chipped after 7 minutes | Outside the present invention (Mo) |
| 14 | 68 | 22 | | Ni 10 | 2.04 | 1,570 | 86 | 89.3 | Chipped after 11 minutes | Outside the present invention (Mo) |
| 15 | 63 | 21 | | Ni 16 | 1.89 | 1,550 | 85 | 90.2 | 0.45 | Outside the present invention (TiN,Ni,Mo) |
| 16 | 63 | 12 | | Ni 25 | 1.89 | 1,550 | 95 | 88.5 | 0.88 | Outside the present invention (TiN,Ni) |
| 17 | 73 | 10 | | Ni 17 | 2.19 | 1,580 | 92 | 89.2 | 0.41 | Outside the present invention (Ni) |
| 18 | 89 | 1 | | Ni 10 | 2.67 | 1,700 | 86 | 90.1 | Chipped after 3 minutes | Outside the present invention (Mo) |
| 19 | 97 | 1 | | Ni 2 | 2.91 | 1,730 | 65 | 90.5 | Chipped after 10 minutes | Outside the present invention (TiN,Ni,Mo) |

As seen from Table 1, among the sintered alloy tips of sample Nos. 1–19, wherein the additional amount of acetylene black to the basic powdery raw material mixture composed of TiN, Mo and/or $Mo_2C$ and binder metal or metals was set at 3 parts by weight based on 100 parts by weight of TiN contained in the basic raw material mixture and the mixing amounts of the powdery components of the basic raw material mixture were varied, the sintered alloy tips of sample Nos. 1–11, wherein the amount of each component was within the range defined in the present invention, were remarkably superior in the properties, particularly in the cutting life, to the sintered alloy tips of sample Nos. 12–19, wherein the amount of at least one of the components was outside the range defined in the present invention. Moreover, in sample Nos. 1–11, there is substantially no difference between Mo and $Mo_2C$ in the effect on the properties of the resulting sintered alloy tips.

In sample Nos. 4–4*d* and 10–10*c*, the influence of the difference in the kind of binder metals upon the properties of the resulting sintered alloy tips was examined under the condition that the mixing amount of TiN was set at an amount near to the middle value of the range defined in the present invention and the mixing amount of Mo and/or $Mo_2C$ was set to 5% by weight or 20% by weight. If was found from the results of the experiments of sample Nos. 4–4d and 10–10c that there was no significant difference between the kinds of binder metals in the influence upon the properties of the resulting sintered alloy tip.

EXAMPLE 2

To 100 parts by weight of the basic powdery raw material mixture of sample No. 6 shown in Table 1, which was composed of 80% by weight of TiN, 10% by weight of Mo and 10% by weight of a binder metal of Ni, was added a variant amount of acetylene black as shown in the following Table 2, and the resulting mixture was treated in the same manner as described in Example 1 to prepare sintered alloy tips of sample Nos. 21–28. Properties of the sintered alloy tips are shown in Table 2.

Table 2

| Sample No. | Composition (parts by weight) TiN | Mo | Binder metal | Acetylene black | Sintering temperature (° C) | Properties of sintered alloy tip: Transverse rupture strength (Kg/mm²) | Hardness (HRA) | Flank abrasion (mm) | Remarks |
|---|---|---|---|---|---|---|---|---|---|
| 21 | 80 | 10 | Ni 10 | 0 | 1,600 | 56 | 89.0 | Chipped after 1 minute | Outside the present invention |
| 22 | " | " | " | 0.16(0.2) | " | 105 | 92.0 | 0.23 | |
| 23 | " | " | " | 0.48 (0.6) | " | 109 | 92.1 | 0.23 | |
| 24 | " | " | " | 0.8 (1.0) | " | 110 | 92.1 | 0.22 | |
| 25 | " | " | " | 2.4 (3.0) | " | 110 | 92.1 | 0.21 | Same as sample No. 6 |
| 26 | " | " | " | 4.0 (5.0) | " | 110 | 92.0 | 0.21 | |
| 27 | " | " | " | 5.45(6.8) | " | 109 | 91.9 | 0.26 | |
| 28 | " | " | " | 5.6 (7.0) | " | 101 | 90.3 | 0.86 | Outside the present |

Table 2-continued

| Sample No. | Composition (parts by weight) TiN | Mo | Binder metal | Acetylene black | Sintering rupture tempera-ture (° C) | Properties of sintered alloy tip: Transverse strength (Kg/mm²) | Flank Hardness (HRA) | Flank abrasion (mm) | Remarks |
|---|---|---|---|---|---|---|---|---|---|
| | | | | | | | | | invention |

Note: The amount of acetylene black described in the parentheses means parts by weight based on 100 parts by weight of TiN.

It can be seen from Table 2 that the effect of acetylene black develops remarkably with a very small additional amount (0.2% by weight based on the amount of TiN), while when the addition amount of acetylene black exceeds 6.8% by weight based on the amount of TiN, properties of the resulting sintered alloy tip deteriorate rapidly.

EXAMPLE 3

Sintered alloy tips were prepared in the same manner as described in Example 1, except that basic powdery raw material mixtures, which were prepared by replacing a part of TiN contained in the basic powdery raw material mixture of sample No. 6 by commercially available TiC, WC and TaC as shown in the following Table 3. Properties of the resulting sintered alloy tips are shown in Table 3.

Table 3

| Sample No. | Composition (parts by weight) TiN | TiC | WC TaC | Mo | Binder metal | Acetylene black | Sintering tempera-ture (° C) | Properties of sintered alloy tip: Transverse rupture strength (Kg/mm²) | Hardness (HRA) | Flank abrasion (mm) | Remarks |
|---|---|---|---|---|---|---|---|---|---|---|---|
| 31 | 80 | | | 10 | Ni 10 | 2.4 | 1,600 | 110 | 92.1 | 0.21 | Same as sample No. 6 |
| 32 | 70 | 10 | | " | " | 2.1 | 1,570 | 110 | 92.1 | 0.22 | |
| 33 | 60 | 20 | | " | " | 1.8 | 1,570 | 109 | 92.3 | 0.22 | |
| 33a | " | 10 | WC 10 | " | " | " | | 116 | 92.0 | 0.24 | |
| 33b | " | " | TaC 10 | " | " | " | | 109 | 92.1 | 0.22 | |
| 34 | 50 | 30 | | " | " | 1.5 | 1,570 | 108 | 92.3 | 0.23 | |
| 35 | " | | WC 30 | " | " | " | | 119 | 92.0 | 0.23 | |
| 36 | " | | TaC 30 | " | " | " | | 110 | 92.1 | 0.21 | |
| 37 | 40 | 40 | | " | 1.2 | 1,550 | 105 | 92.3 | 0.26 | | |
| 38 | 30 | 50 | | " | " | 09 | 1,550 | 100 | 92.0 | 0.41 | Outside the present invention |
| 39 | " | 25 | WC 25 | " | " | " | " | 99 | 92.0 | 0.48 | " |
| 40 | " | " | TaC 25 | " | " | " | " | 92 | 91.8 | 0.46 | " |

It can be seen from Table 3 that in sample Nos. 32–37, wherein not more than 50% by weight (not more than one-half) of the amount of TiN contained in the basic raw material mixture of sample No. 6 shown in Table 1 is replaced by TiC, WC and TaC, sintered alloy tips can be produced at a sintering temperature lower than that of sample No. 6 and the tips have a long cutting life. While, in sample Nos. 38–40, wherein more than 50% by weight (more than one-half) of the amount of the TiN is replaced by TiC, WC and TaC, flank abrasion of the resulting sintered alloy tips is large. Further, plastic deformation occurred in the cutting edge of the sintered alloy tips of sample Nos. 38–40, and the tips were not able to be used practically.

When a basic powdery raw material mixture composed of TiN, not more than 50% by weight of the amount of the TiN being capable of being replaced by at least one of TiC, WC and TaC, Mo and/or $Mo_2C$ and a binder metal is mixed with 0.2–6.8 parts by weight of powdery carbon based on 100 parts by weight of TiN contained in the basic raw material mixture according to the method of the present invention and the resulting mixture is molded and sintered by a conventional method, the added powdery carbon and fine TiN particles become dissolved into the binder metal at the sintering while nitrogen in said TiN is vapored out, and then the dissolved carbon and titanium precipitate on the surface of unmelted TiN particles in the form of a complex carbide composed of TiC and $Mo_2C$ or a complex carbide composed of TiC, $Mo_2C$ and at least one of TiC, WC and TaC, both of the complex carbides being Ti-base carbides having good wettability with iron family metals, and cover the unmelted TiN particle surface. As the result, titanium nitride-based uniform and dense sintered alloys composed of two phases, a ceramic phase and a binder metal phase, having neither partially grown extraordinary grain nor pores can be obtained. When carbon is added to a basic powdery raw material mixture by merely replacing TiN contained in the mixture by TiC in an amount corresponding to the amount of carbon to be added to the mixture, titanium nitride-base sintered alloys having the above described structure, particularly having uniform and dense structure, cannot be obtained. This fact will be understood more concretely from the results of the following experiments.

A sintered alloy tip of sample No. 24 described in Table 2 having a composition composed of 80 parts by weight of TiN, 10 parts by weight of Mo, 10 parts by weight of Ni and 0.8 part by weight of acetylene black, and a sintered alloy tip of sample No. 24a having a composition composed of 4 parts by weight of TiC, whose carbon content corresponds to 0.8 part by weight of acetylene black, 76 parts by weight of TiN, 10 parts by weight of Mo and 10 parts by weight of Ni were prepared in the same manner as described in Example 1, and the behavior of the sintered alloy tip samples during the sintering was examined.

The lattice constant of the ceramic phase of the samples during the sintering was examined by the X-ray diffractiometry. In sample No. 24, the lattice constant became 4.29 A at a low sintering temperature of 1,300°

C. This shows that a complex carbide containing TiC has been deposited and diffused on the surface of TiN and the wettability of the TiN with Ni has been improved at 1,300° C in sample No. 24. While, in sample No. 24*a*, peaks showing the lattice constants of TiN and TiC appeared separately at 1,300° C (the lattice constant of TiN used was 4.24 A and that of TiC used was 4.34 A), and when the temperature reached 1,400° C, these two peaks disappeared and one peak corresponding to the lattice constant of 4.29 A appeared. This shows that TiC covers the surface of TiN at a higher temperature of 1400° C in sample No. 24*a*. Accordingly, in sample No. 24*a*, particles of TiN and of TiN or particles of TiN and of TiC are partially adhered, and extraordinary grains grow and pores are formed before a final sintering temperature. However, in sample No. 24, the ceramic phase is separated by the liquid phase (binder metal phase) and maintained uniformly and finely until the final sintering temperature.

The sintered alloy of sample No. 24 had a hardness of 92.1 (HRA), while that of sample No. 24*a* had a lower hardness of 91.0 (HRA). When these sintered alloys were used as a cutting tool, the sintered alloy of sample No. 24*a* was inferior to that of sample No. 24 in the abrasion resistance and thermal shock resistance. That is, in the same machinability test as described in Example 2, the flank abrasion of sample No. 24 was 0.22 mm, while that of sample No. 24*a* was as large as 0.51 mm.

In the present invention, the addition amount of carbon to the basic powdery raw material mixture is limited to 0.2–6.8 parts by weight based on 100 parts by weight of TiN contained in the mixture. The reason why the upper limit is limited to 6.8 parts by weight is that, when the amount of carbon exceeds 6.8 parts by weight, the TiC-base carbide layer becomes too thick and an excess amount of carbon is separated out in the binder metal, and as the result the object aimed in the present invention cannot be attained. As to the carbon, fine powdery carbon is preferably used, and amorphous carbon, such as acetylene black, is particularly preferable. Further, organic carbonaceous materials, such as saccharose, glycerine and the like, which carbonize during the sintering, may be used in such an amount that the carbon content in these carbonaceous materials is within the range defined in the present invention.

In the present invention, the amount of TiN contained in the basic powdery raw material mixture is limited to 65–95% by weight. When the amount of the TiN is less than 65% by weight, excellent properties inherent to TiN cannot be fully developed, while when the amount of the TiN exceeds 95% by weight, the defect of TiN appears and the hardness of the resulting sintered alloy decreases. Mo and $Mo_2C$ act similarly to the case of TiC-base cermets, and diffuse in the TiC-base coating layer in the form of metal or carbide to improve the wettability of the TiC-base coating layer with the binder metal and further are solid-solved with TiC to improve the toughness of the resulting sintered alloy. However, when the amount of Mo and $Mo_2C$ contained in the basic powdery raw material mixture is less than 2% by weight, the effect of Mo and $Mo_2C$ is not fully developed, while when the amount of Mo and $Mo_2C$ contained in the mixture exceeds 20% by weight, the resulting sintered alloy becomes brittle. Therefore, the amount of Mo and $Mo_2C$ to be contained in the basic powdery raw material mixture is limited to 2–20% by weight. When the amount of iron family metal contained as a binder metal in the basic powdery raw material mixture is less than 3% by weight, the edge of the resulting sintered alloy cutting tool is broken due to insufficient toughness, while when the amount of iron family metal contained in the mixture exceeds 15% by weight, plastic deformation of the cutting tool occurs noticeably at high speed continuous cutting, and the hardness at high temperature and the abrasion resistance of the cutting tool decrease. Therefore, the amount of iron family metal to be contained in the basic powdery raw material mixture is limited to 3–15% by weight.

In the present invention, when not more than 50% (not more than one-half) of the amount of TiN contained in the basic powdery raw material mixture is replaced by at least one of TiC, WC and TaC having excellent heat stability and good wettability with the binder metal, sintered alloys can be produced at a sintering temperature lower than that in the case when the TiN is not replaced by TiC, WC and TaC. That is, when a basic powdery raw material mixture composed of TiN, Mo and/or $Mo_2C$ and the binder metal is used, a sintering temperature of 1,570°–1,730° C is necessary. While, when not more than 50% by weight of the amount of TiN contained in the mixture is replaced by TiC, WC and TaC, the sintering temperature can be lowered by about 30°–50° C. However, when more than 50% by weight of the amount of TiN is replaced by TiC, WC and TaC, adverse affects of these carbides appear and the resulting sintered alloy loses excellent properties inherent to TiN-base sintered alloys. Therefore, the upper limit of the amount of TiN to be replaced by TiC, WC and TaC is 50% by weight. Further, in this replacement, TiC may be used in the form of TiCN (titanium carbonitride).

According to the present invention, TiN can be mixed with carbides, such as WC, TiC and the like, in an amount considerably larger than 20% by weight based on the amount of the carbides, said amount of 20% by weight having been considered to be the upper limit of the mixing ratio of TiN to the carbides in the conventional method, and titanium nitride-base sintered alloys having high thermal shock resistance inherent to TiN and further having various excellent properties, particularly having excellent durability in the high speed continuous or intermittent cutting of cast iron, can be obtained.

What is claimed is:

1. A method for producing titanium nitride-base sintered alloys, which comprises mixing carbon with a basic powdery raw material mixture composed of 65–95% by weight of TiN, 2–20% by weight of Mo and/or $Mo_2C$ and 3–15% by weight of at least one iron family metal, the mixing amount of said carbon being 0.2–6.8 parts by weight based on 100 parts by weight of TiN contained in the basic raw material mixture, molding the resulting mixture and sintering the molded article, wherein when the molded article is sintered, the metal melts first, with fine particles of TiN and carbon dissolving into the molten metal while nitrogen gas escapes therefrom, and the dissolved carbon and titanium precipitate in the form of TiC on the surface of longer TiN particles, thereby resulting in a TiN-base sintered alloy composition.

2. A method according to claim 1, wherein not more than 50% by weight of the amount of TiN contained in the basic powdery raw material mixture is replaced by at least one of TiC, WC and TaC.

3. A method according to claim 1, wherein said carbon is acetylene black.

4. A method according to claim 1, wherein said carbon is added to the basic powdery raw material mixture in the form of an organic carbonaceous material.

5. A TiN-base sintered alloy produced by the method of claim 1.

6. A TiN-base sintered alloy produced by the method of claim 2.

7. A TiN-base sintered alloy produced by the method of claim 3.

8. A TiN-base sintered alloy produced by the method of claim 4.

* * * * *